United States Patent [19]

Witten

[11] Patent Number: 4,649,655

[45] Date of Patent: Mar. 17, 1987

[54] DRILLING MUD DEHYDRATION SYSTEM

[75] Inventor: Eric B. Witten, Anchorage, Ak.

[73] Assignee: Atlantic Richfield Company, Los Angeles, Calif.

[21] Appl. No.: 829,383

[22] Filed: Feb. 13, 1986

[51] Int. Cl.[4] ..... F26B 11/04

[52] U.S. Cl. ..... 34/135; 34/141; 175/66; 175/206; 432/107; 432/112

[58] Field of Search ..... 202/120, 124, 126, 217, 202/221; 175/66, 206; 34/120, 122, 110, 135; 432/112, 107

[56] References Cited

U.S. PATENT DOCUMENTS

| | | | |
|---|---|---|---|
| 2,919,898 | 1/1960 | Marwil et al. | 175/66 |
| 4,043,745 | 8/1977 | Unger | 432/112 |
| 4,280,879 | 7/1981 | Taciuk | 202/100 |
| 4,319,410 | 3/1982 | Heilhecker | 34/92 |

*Primary Examiner*—Larry I. Schwartz
*Attorney, Agent, or Firm*—Michael E. Martin

[57] ABSTRACT

Apparatus for dehydrating slurries such as water based drilling fluids heavily laden with drill cuttings and other earth solids comprising a rotating drum which is heated by combustion of a fuel air mixture to generate relatively large quantities of combustion products for heating in an enclosed chamber defined by said drum. The slurry to be dehydrated is injected into the interior of the drum or against the outer sidewall thereof for rapid exposure and substantially flash evaporation of the slurry liquids. An outer housing may be constructed around the drum and in one embodiment the drum is arranged inclined to the horizontal with the slurry introduced into the interior of the drum and the combustion chamber formed between the outer housing and the drum. In another embodiment the combustion chamber is formed on the interior of the drum and the evaporation chamber is formed between the drum and the outer housing. The exhaust flues for the evaporation chamber and the combustion chamber are interconnected to provide for induced flow of gases through a stack portion of one of the flues and to dilute the vapor flow stream to minimize the generation of condensation clouds or ice fogs during operations in cold environments.

12 Claims, 7 Drawing Figures

DRILLING MUD DEHYDRATION SYSTEM

BACKGROUND OF THE INVENTION

1. Field of the Invention

The present invention pertains to an indirect fired drying or dehydration apparatus particularly adapted for dehydrating well circulation fluids such as drilling muds containing substantial quantities of drill cuttings and similar solids.

2. Background

The continued and ever-increasing level of consciousness regarding proper handling of waste materials and disposal of such materials in an environmentally safe and acceptable manner has caused significant concern in the well drilling industry. The handling of well drilling circulation fluids or drilling muds which have become heavily contaminated with drill cuttings, including the disposal of the drill cuttings themselves, has typically been dealt with by digging a pit in the vicinity of the well drilling operation for collection of the drill cuttings and the quantities of fluids which cannot be entirely separated from these cuttings.

In certain areas, such as off-shore drilling operations and operations in the Arctic, the disposal of drill cuttings and the quantities of fluids that cannot be entirely separated from the cuttings has required the transport of these substances to suitable on-shore sites, in the case of off-shore operations, and the construction of specially lined disposal pits. However, the construction of these pits in Arctic regions has been deemed undesireable for several reasons and new methods of disposal and dehydration of drill cuttings and drilling fluids have been sought.

The disposal of well drilling cuttings or solid material generated in the drilling of a well should take into consideration the composition of the liquid base of the circulation fluid. In those instances where the liquid is primarily water, a suitable disposal method may be accomplished by indirect vaporization of the solids-laden fluids whereby substantially dry earthlike materials are then left for disposal and water or other evaporable or combustible substances may be treated in a manner whereby disposal into the atmosphere is acceptable.

It is an object of this invention to provide an improved apparatus and method for treating drilling fluids which are laden with drill cuttings solids and other fluids generated in the drilling process whereby substantially dehydrated solid particles are provided which may be disposed of in various ways, including possibly use as a construction material. It is a further object of the present invention to provide a method and apparatus for treating drill cuttings whereby evaporable or combustible liquids may be subjected to high enough temperatures to cause complete vaporization and some oxidation so that resultant vapors, such as water vapor and carbon dioxide, may be discharged into the atmosphere directly after the dehydration process.

SUMMARY OF THE INVENTION

The present invention provides an improved apparatus and method for dehydrating slurries of such materials as well circulation fluids which include substantial quantities of borehole cuttings. In accordance with the invention, drill cuttings may be returned to the environment upon complete dehydration and oxidation of these substances which are possibly deleterious if otherwise disposed of, such as by discharge into open pits or into waterways or water reservoirs.

In accordance with one aspect of the present invention, there is provided an indirect drying apparatus comprising a rotating drum, a combustion system for heating the drum and an arrangement for discharging a slurry of substantially water-based mud or like matter, including drill or borehole cuttings, onto a surface of the drum to rapidly dehydrate the solids in the slurry and to discharge the solids from the apparatus while conducting gaseous combustion products and liquid vapors out of the apparatus for discharge into the atmosphere through suitable filtration means, if necessary.

In accordance with another aspect of the present invention, there is provided an apparatus for dehydrating slurry-like material comprised primarily of water, small amounts of hydrocarbons, siltlike materials and solid particles wherein the slurry is discharged onto a surface of a rotating drum and the dehydrated solid particles are allowed to be discharged primarily by gravity from one end of the drum. Gaseous combustion products generated during the heating or dehydration process, together with vapor or evaporated liquids, are discharged by convection flow through a flue and are preferably mixed in the flue to dilute the water vapor content of the flue gases. This last mentioned feature is particularly attractive for use of the apparatus in colder climates to minimize the production of ice fog in the atmosphere.

In accordance with yet another aspect of the present invention, there is provided an apparatus which is adapted to dehydrate relatively large quantities of slurry-like materials such as drill cuttings and quantities of circulation fluids which have been disposed of in so-called reserve pits or holding tanks as a result of separation processes during well drilling operations. The apparatus is particularly economical to produce, is mechanically uncomplicated and is adapted to handle relatively large volumes of the slurry materials on a continuous basis. The apparatus is also configured to rely substantially on convection flow of air for combustion and for dehydration functions and is configured to provide for solids removal from the apparatus by gravity flow. Assistance in discharging solids material accumulating on the surface of the drum is provided by a scraper bar, or the like, and the drum is preferably rotated continuously during operation to distribute the slurry over the surfaces of the drum during the dehydration process.

The present invention further contemplates an improved system for dehydrating slurries of water base drilling muds and the like which are particularly heavily laden with drill cuttings whereby, on a substantially continuous basis, the drilling mud/drill cuttings slurry is exposed to a high temperature environment by discharging the slurry on the surface of a rotating drum or the like. The improved system also contemplates the provision of relatively large, unobstructed flow paths for air for drying and conveying the vapors evaporated from the slurry and for discharging dehydrated solids to a collection point whereby the solids may be conveyed and distributed to a final disposal site.

Those skilled in the art will recognize the above described advantages and features of the present invention, as well as additional superior aspects thereof upon reading the detailed description which follows in conjunction with the drawing.

DESCRIPTION OF PREFERRED EMBODIMENTS

Figures 1, 2, 3:
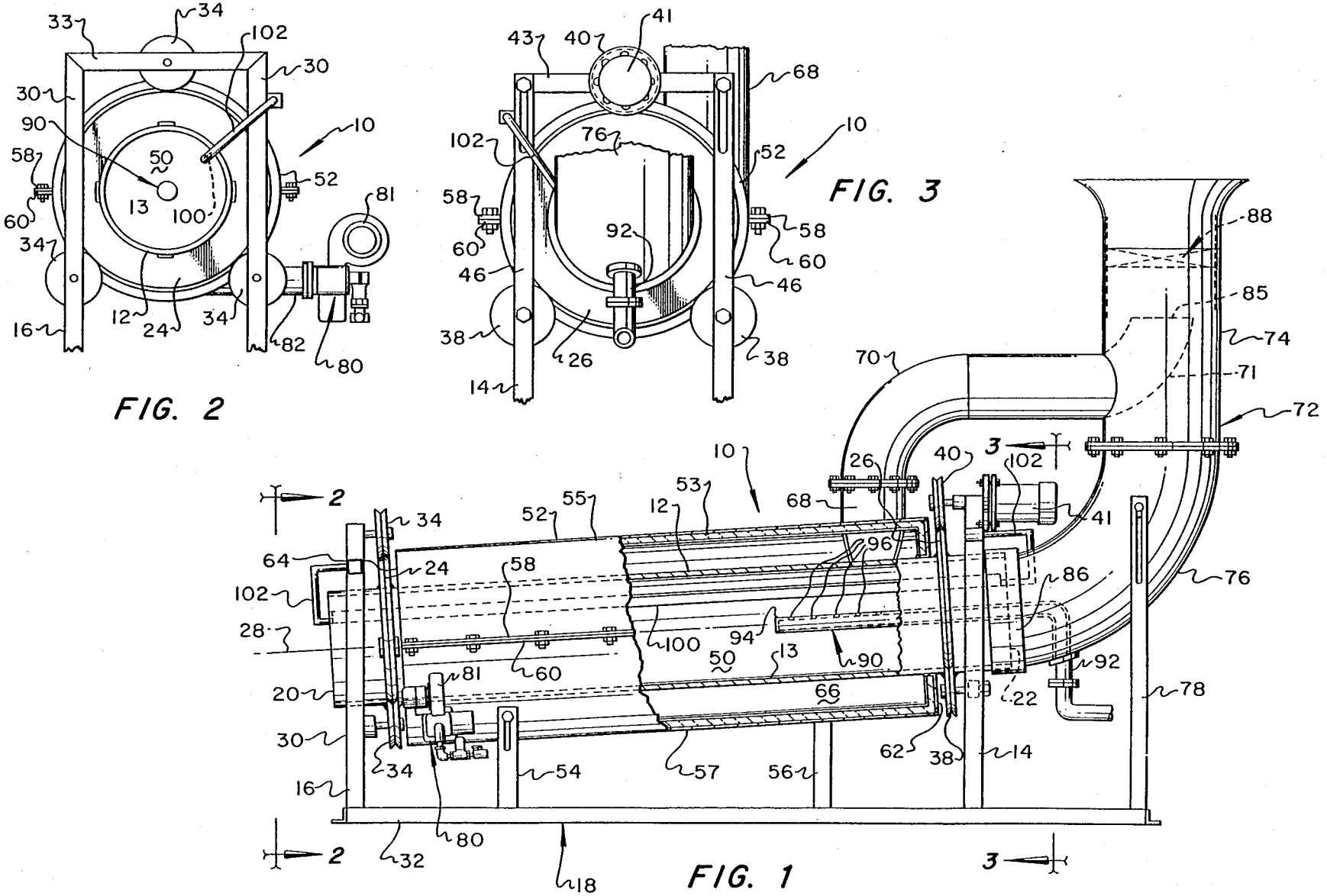
FIG. 1 is a side elevation, partially sectioned, of a dehydration apparatus in accordance with the present invention.
FIG. 2 is an end view of the apparatus taken generally from line 2—2 of FIG. 1.
FIG. 3 is a view taken substantially along the line 3—3 of FIG. 1.
Figure 4:
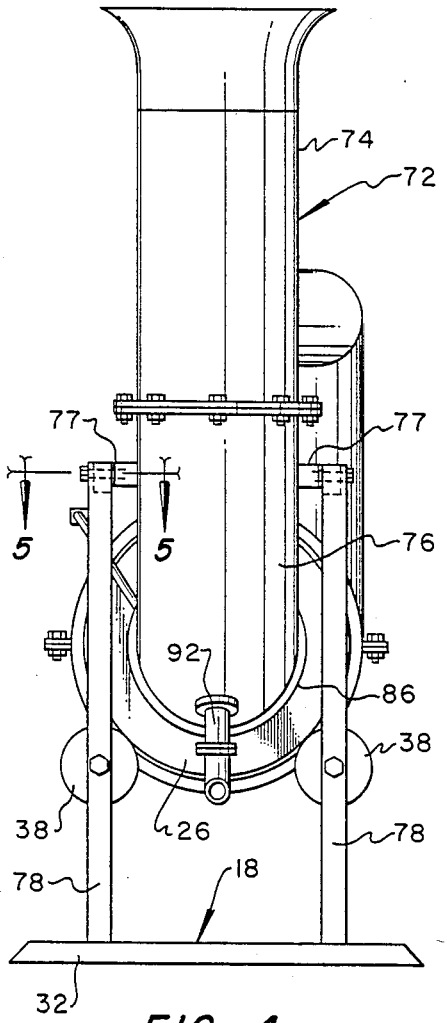
FIG. 4 is a view of the end of the apparatus, opposite that shown in FIG. 2.

In the description which follows, like parts are marked throughout the specification and drawing with the same reference numerals, respectively. The drawing figures are not necessarily to scale and certain features of the invention may be shown in somewhat schematic form. Conventional elements and adaptations may also be illustrated in somewhat schematic form in the interest of clarity and conciseness.

Referring to FIGS. 1 through 4, in particular, there is illustrated one embodiment of an improved apparatus for treating slurrylike materials, particularly slurries of subterranean well borehole cuttings produced during the drilling process. The apparatus illustrated is generally designated by the numeral 10 and is characterized by an elongated, cylindrical drum 12 which is supported for rotation on spaced apart supports, generally designated by the numerals 14 and 16, respectively, which comprise part of a support frame 18 for the apparatus. The drum 12 is preferably made of alloy or stainless steel and is characterized as a substantially elongated cylindrical tube which is opened at its opposite ends 20 and 22, respectively, to provide a substantially unobstructed flow of air therethrough. The drum 12 includes spaced-apart generally cylindrical support flanges 24 and 26 which are engageable with respective sets of support rollers to provide for rotation of the drum about its central longitudinal axis 28.

Referring to FIG. 2, for example, the support 16 is characterized by spaced apart upstanding members 30 extending from a base 32 of the frame 18, which members are interconnected by a transverse member 33. Adjustable support rollers 34 are mounted on the support 16 and engageable with the support flange 24 to support one end of the drum 12 for rotation about axis 28. The opposite end of the drum 12 is also supported on a set of rollers 38 and at least one drive roller 40. The rollers 38 may be configured to have somewhat V-shaped grooves and the flange 26 may be configured to have a somewhat V-shaped crown to control longitudinal excursion of the drum 12 and to increase the drive forces transmitted between the drive roller 40 and the flange 26.

Referring to FIG. 3, also, the support 14 is characterized by spaced apart upstanding support members 46 interconnected by transverse members 48. The support rollers 38 and the drive roller 40 are mounted for adjustment generally vertically on the support members 46 whereby the angle formed by the axis 28 with respect to the horizontal or the frame base 32 may be adjusted to adjust the so-called pitch of the drum 12 with respect to the horizontal. The drive roller 40 is suitably connected to drive motor means 41 mounted on a vertically adjustable transverse support bar 43. The motor means 41 may be fluid or electrically energized. Those skilled in the art will recognize that other means for rotating the drum 12 about its axis 28 may be provided such as a chain or belt drive arrangement suitably engageable with the drum and supported on the frame 18.

Referring to FIG. 1, the apparatus 10 is also provided with means for heating the drum 12 and in particular a dehydrating chamber 50 formed in the interior of the drum. The heating means comprises a generally cylindrical housing 52 disposed about the drum 12 and suitably supported for vertical adjustment with the drum 12 by means including spaced apart support members 54 and 56 on the frame 18. The housing 52 may typically be formed of opposed steel plate cylindrical half-sections 55 and 57 which are secured together along opposed mating flanges 58 and 60, see FIGS. 2 and 3 also. The housing 52 includes opposed transverse end walls 62 and 64 configured such that the drum 12 projects through both end walls as illustrated in FIG. 1.

Figure 5:
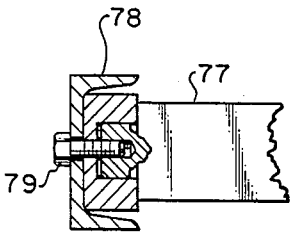
FIG. 5 is a detailed section view taken along the line 5—5 of FIG. 4.

The housing 52, together with the drum 12, defines a generally annular combustion chamber 66, FIG. 1, having an outlet or exhaust conduit 68 for discharging combustion products from the chamber 66 and located generally at one end of the housing 52 adjacent to the end wall 62. The exhaust conduit 68 is connected to a combustion products flue conduit 70 comprising a member which extends into a second exhaust stack or flue 72 having a vertical stack portion 74 and a curved duct section 76, supported on the frame 18 for vertical adjustment with respect thereto on spaced apart support members 78. The duct section 76 is preferably supported by opposed trunnions 77, FIGS. 4 and 5, which are mounted for vertical adjustment along the channel shaped members 78 by fasteners 79, FIG. 5.

The combustion chamber 66 is in communication with a gas fired burner assembly generally designated by the numeral 80 which is mounted at the end of the housing 52 adjacent the end wall 64. Referring to FIG. 2 also, the burner assembly 80 is preferably of a type commercially available and is adapted to be connected to a source of fuel such as natural gas or the like, not shown. The burner assembly may, for example, be of a type manufactured by Eclipse, Inc., Rockford, Ill., as their type 200 JIB-C-2 Incinerator Burner. The burner assembly 80 is adapted to supply combustion air to the chamber 66 by an integral motor driven fan 81.

The burner assembly 80 is mounted in such a way that a short injection conduit section 82 is provided for discharging a high velocity flow of burning gases and combustion air into the chamber 66 in such a way that a generally circular and somewhat helical flow of combustion gases progresses through the combustion chamber 66 toward the exhaust conduit 68 to provide substantially uniform heating of the rotary drum 12. Suitable seals are provided between the transverse end walls 62 and 64 and the outer surface of the drum 12 to prevent all but an insignificant leakage flow of combustion gases from the combustion chamber 66 at opposite ends of the housing 52. The housing 52 is preferably a relatively thin walled steel structure having a suitable insulating blanket 53, FIG. 1, formed on the inner surface thereof to minimize heat losses through the housing itself.

Referring again to FIGS. 1 and 4, the curved duct section 76 of the flue 72 includes a generally cylindrical collar 86 which is fitted over the distal end 22 of the drum 12 and is stationary relative to the drum so that the flue 72 may receive the relatively large flow volume of vapor generated in the chamber 50 and the induced flow of air which enters the chamber 50 through the open end 20 of the drum 12. As illustrated in the drawing figures, the longitudinal central axis 28 of the drum 12 is inclined slightly upwardly so that the end 22 is at a higher elevation than the end 20. The support members for the rollers 38 and 40 are preferably vertically adjustable relative to the rollers 34 so that the angle of inclination of the axis 28 may be selectively adjusted. This angle of inclination of the drum 12 relative to the horizontal provides two major benefits in that the flow of vapor generated by heating a slurry introduced into the chamber 50 and a flow of ambient air into the open end 20 progresses toward and through the end 22 of the drum 12 and up through the flue 72. Moreover, the dehydrated slurry solids which are discharged into the chamber 50 collect on the inner surface of the drum 12 and, with rotation of the drum, migrate toward the open end 20 and exit therefrom for collection and transportation to a suitable disposal site.

Not only is the flow of vapor and the induced air flow through the chamber 50 caused to flow through the flue 72 due to natural convection, but the discharge of combustion gases through the combustion products flue 70 also induces flow of air and vapor through the flue 72 by entrainment or the ejector effect. In this regard, the combustion products flue 70 has a discharge duct portion 71 which extends through the sidewall of the stack 74 and has an outlet end 85 arranged to direct the combustion gas flow vertically upward in the stack 74 to mix with the relatively large flow volume of induced air flow, water vapor and other liquid vapors which have been generated in the chamber 50. This dilution of the concentration of water vapor is particularly advantageous in applications of the apparatus of the present invention in very low ambient temperatures such as are experienced in Arctic oil field operations whereby the generation of ice fogs at the outlet of the flue 72 is minimized. Referring to FIG. 1, the flue 72 may also be provided with a particle filter 88 disposed in the stack 74 to filter out any fines which may be induced to flow with the vapor flow stream exiting the drum 12 through the end 22.

The slurry of well circulation fluid, drill cuttings and fluids mixed with the well circulation fluid during drilling operations is introduced into the chamber 50 through a conduit 90 which is suitably supported on the flue duct section 76 and includes an inlet end 92 extending through a bottom wall portion of the duct 76 and having an elongated discharge nozzle portion 94 extending substantially coaxially into the chamber 50 and provided with a plurality of spaced apart nozzle orifices 96 formed thereon. The slurry injection conduit 90 is suitably supported in the duct 76 so that the cantilever nozzle portion 94 is not required to be supported by the rotating drum 12. However, if necessary, the nozzle portion 94 could be extended farther toward the end 20 of the drum 12 and supported on suitable bearing means within the drum to permit rotation of the drum relative to the nozzle section. The slurry injection conduit 90 is adapted to be connected to a source of slurry to be dehydrated, not shown, through suitable pump means, also not shown.

Referring further to FIGS. 1 and 2, the drum 12 is also provided with means for continuously scraping the interior surface 13 of the drum 12 and comprising an elongated scraper bar 100 which extends into the chamber 50 through the open ends of the drum and is supported by spaced apart support brackets 102 connected to the drum supports 14 and 16. One of the support brackets 102 extends through a suitable opening formed in the duct 76. Thanks to the scraper bar 100, any tendency for solid particles to collect on the surface 13 is minimized and the provision of the scraper bar 100 aids in discharge of the solids which tend to collect in the chamber 50 as the drum 12 is rotated. The combination of the scraper bar 100 and the inclined attitude of the drum 12 assures relatively continuous migration of the dehydrated solids toward the open end 20 of the drum.

In operation of the apparatus 10, the drum 12 is preferably continuously rotated at a selected speed which will assure complete dehydration of the solid particles which are injected in the slurry into the chamber 50 through the conduit 90. This dehydration process is carried out largely through the process of heating the slurry injected into the chamber 50 indirectly by the combustion of a gaseous or liquid fuel in the combustion chamber 66, preferably under a forced draft process utilizing the burner assembly 80. High velocity flow of the gaseous combustion products with an airflow substantially in excess of the stoichiometric ratio occurs in the chamber 66 and the flow of combustion products undergoes a somewhat helical flow path from the inlet to the housing 52 at the burner assembly to the combustion products exhaust outlet conduit 68. The rapid outflow of combustion products through the combustion products flue 70 into the flue 72 also aids in inducing the flow of ambient air and vapors generated in the chamber 50 through the flue 72 whereby dilution of the vapors is enchanced by the induced air flow and by mixing with the combustion products to minimize the chance of the accumulation of large ice fog clouds when the apparatus 10 is being operated at ambient temperatures below 32° F.

As the slurry is injected into the chamber 50, it falls into contact with the drum wall 13 and in the presence of high temperature in the chamber 50 the solid particles in the slurry are substantially dried and stripped of any deleterious substances such as traces of hydrocarbon fluids and the like by oxidation of these substances. The relatively large flow of ambient air through the chamber 50 from the end of the drum 20 to and through the end 22 assists in oxidizing any substances on the earth solids being dehydrated. Thanks to the inclination of the drum 12, the dehydrated solids migrate toward the open end 20 and are continuously scraped free from adherence to the drum wall 13 by the elongated scraper bar 100.

Figure 6:
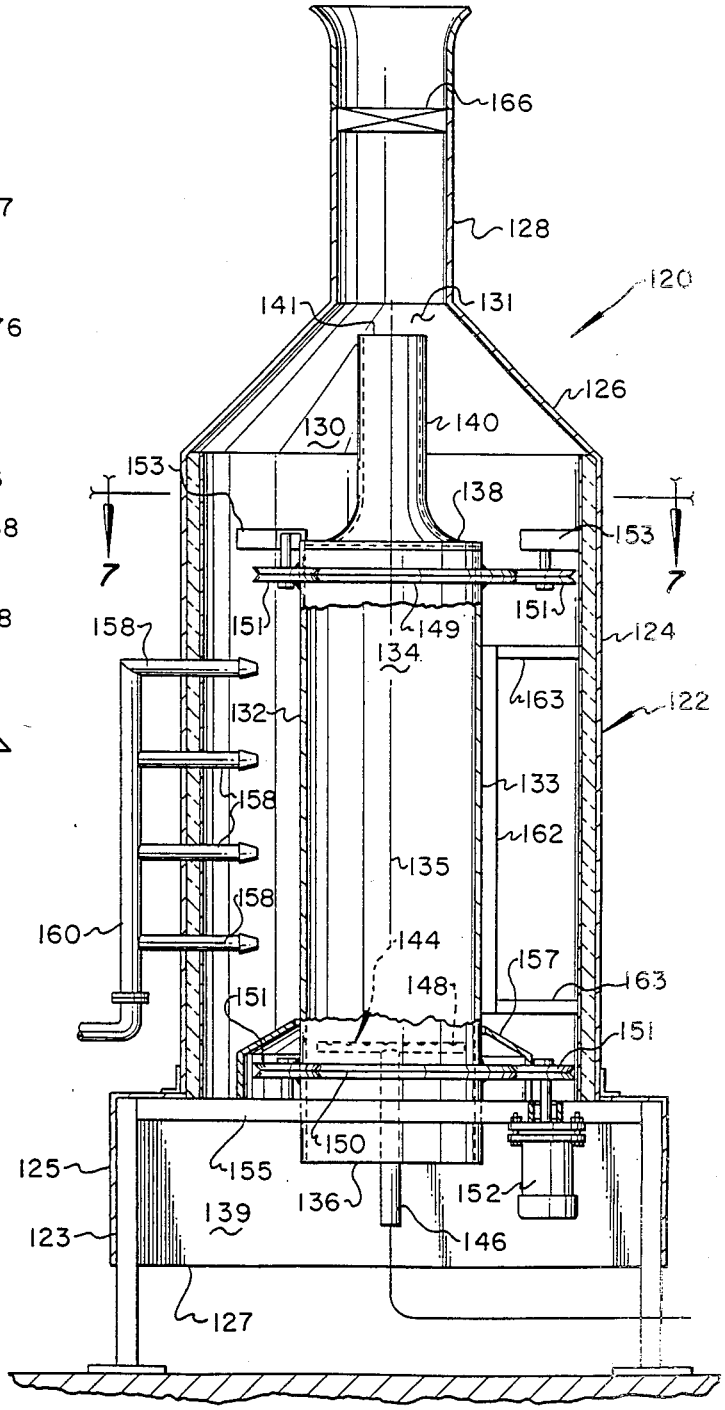
FIG. 6 is a vertical central section view, in somewhat schematic form, of an alternate embodiment of the apparatus of the present invention.
Figure 7:
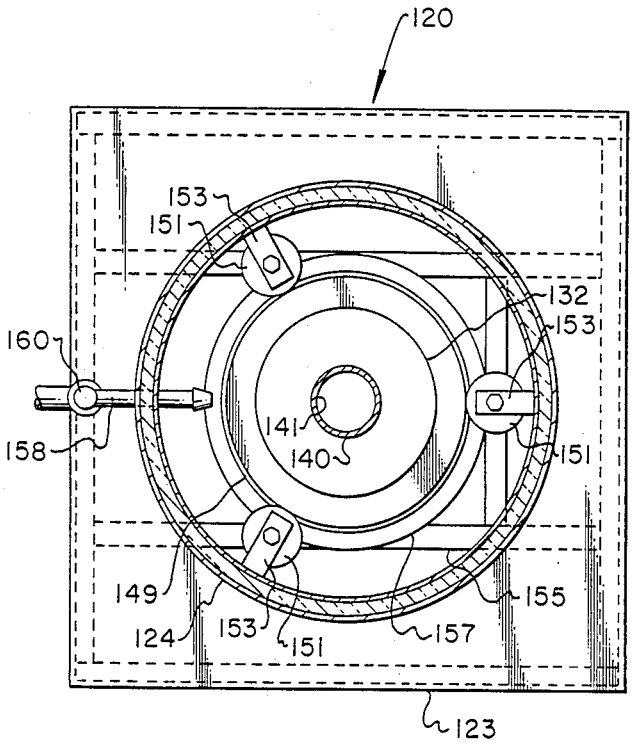
FIG. 7 is a transverse section view taken generally along the line 7—7 of FIG. 6.

Referring now to FIGS. 6 and 7, there is illustrated an alternate embodiment of the present invention, comprising a dehydration apparatus generally designated by the numeral 120. The apparatus 120 includes a generally cylindrical outer housing 122 having a substantially cylindrical insulated housing section 124, a somewhat frustoconical shaped dome section 126 and a generally vertical exhaust flue or stack portion 128. The housing 122 defines an interior slurry dehydration chamber 130 in which is disposed a generally cylindrical elongated hollow drum member 132. The drum 132 defines an interior combustion chamber 134. The longitudinal central axis 135 of the drum 132 is inclined at a relatively steep angle to the horizontal, preferably vertical. For convenience, one end of the drum 132 is designated as the lower end 136 and the opposite end 138 is designated as the upper end.

The lower end 136 of the drum 132 is substantially open to atmosphere and the upper end 138 is provided with a combustion products exhaust flue or stack 140. The stack 140 opens into the throat 131 of the chamber 130 just below the exhaust stack portion 128. The combustion products stack 140 may have a somewhat convergent nozzle configuration to increase the velocity of combustion gases exiting through the opening 141 into the interior of the stack 128 so as to induce the flow of slurry vapor and ambient air out of the chamber 130. The combustion chamber 134 is provided with a burner assembly 144 supported on a suitable conduit section 146. The burner assembly 144 may be provided with a multiport burner tube 148 arranged substantially transversely across the chamber 134 adjacent the lower end 136 of the drum 132. The drum 132 includes spaced apart cylindrical flanges 149 and 150 which are journaled for rotation by respective sets of rollers 151 mounted on suitable supports 153 and 155. One of the rollers 151 is operably connected to motor means 152 for driveably rotating the drum about the axis 135. The flange 150 is preferably shielded by a generally frustoconical shield 157 disposed about the drum 132. The shield 157 is cut away to provide space for respective ones of the lower set of rollers 151.

As illustrated in FIG. 6, relatively viscous slurry resulting from the separation of drill cuttings and the like from a drill circulation fluid may be pumped into the interior of the housing 122 through a plurality of vertically spaced apart injection nozzles 158 which are each connected to a supply manifold 160 in communication with suitable pump means, not shown, for supplying the slurry to the respective nozzles. The nozzles 158 are adapted to direct a flow of slurry against the cylindrical wall 133 of the drum 132 whereupon the heated surface of the wall will act to dehydrate the relatively fine solids which are entrained in the slurry solution. Accumulation of dried or partially dried material on the drum wall 133 is prevented by a generally vertically extending scraper bar 162 which is suitably supported in the interior chamber 130 by spaced apart support members 163 and is engageable with the wall 133 for removing any material which may tend to stick to the wall surface. The dehydrated solids will drop to the bottom of the chamber 130 and into an enlarged plenum area 139 defined in part by a rectangular support base 123 for the housing 122. The base 123 is preferably provided with a skirt 125 forming a suitable opening 127 to permit a substantial flow of air into the plenum 139 and flow through the chamber 130 and the combustion chamber 134. Suitable means, not shown, may be employed for removing the accumulation of dried solids which fall into the plenum space 139 from the upper regions of the chamber 130.

Operation of the apparatus 120 is similar to the apparatus 10 in that the drum 132 is continuously rotated during combustion of a mixture of air and fuel in the combustion chamber 134 to heat the chamber 130 and the outer surface of the wall 133 so that, upon spraying the slurry material into the chamber 130, the solids entrained in the slurry are rapidly dehydrated and allowed to fall into the plenum 139 for suitable removal. The large quantities of water vapor and other liquid vapors which are generated in the chamber 130 flow rapidly upwardly into the stack 128 and this flow is accelerated to some extent by the flow of combustion gases which exit through the nozzle 140 into the throat area 131 of the chamber 130 to assist in inducing the flow of vapors and induced air flow coming into the chamber 130 through the opening 127. As with the apparatus 10, operation in subfreezing environments may be carried out without the tendency to produce substantial clouds of condensed water vapor or ice fog at the outlet of the exhaust stack 128. In certain applications of the apparatus 120, it may also be necessary to include suitable filtration means 166 such as an electrostatic type precipitator or an impingement type filter interposed in the stack 128.

Those skilled in the art will recognize that the dehydration apparatus described herein provides a unique and uncomplicated device for handling liquid-solids mixtures, particularly slurrylike remainders of water based drilling fluids in which substantial quantities of drill cuttings or other earth solids are disposed.

Although preferred embodiments according to the present invention have been described herein, those skilled in the art will recognize that various substitutions and modifications may be made to the specific embodiments described without departing from the scope and spirit of the invention as recited in the appended claims.

What I claim is:

1. Apparatus for dehydrating a slurry such as well drilling fluid containing a quantity of solids comprising drill cuttings, said apparatus comprising:

a generally cylindrical outer housing;

an elongated cylindrical drum disposed in said outer housing and dividing a space in said housing into first and second chambers defined at least in part by said drum, said drum being substantially open at opposite ends thereof for conducting heated gas through said drum;

means for burning a fuel in one of said chambers to generate gaseous combustion products to heat said drum and said chambers;

means for supporting said drum for rotation generally about its longitudinal central axis and in and relative to said housing;

means for discharging said slurry into the other of said chambers and against a sidewall of said drum for dehydrating said slurry;

first exhaust flue means in communication with said other chamber for conducting a flow of vapor generated from dehydrating said slurry away from said apparatus; and second exhaust flue means in communication with said one chamber for conducting said combustion products out of said said one chamber.

2. The apparatus set forth in claim 1 wherein:

said axis is inclined with respect to the horizontal to provide for gravity flow of solids away from said drum at one end thereof.

3. The apparatus set forth in claim 2 wherein:

said axis is substantially vertical.

4. The apparatus set forth in claim 1 including:

filter means disposed in said stack for filtering fine solids from said vapors being discharged from said flue means.

5. The apparatus set forth in claim 1 wherein:

said means for discharging said slurry includes an elongated conduit extending within said other chamber, said conduit including spaced apart nozzles for discharging slurry against said sidewall.

6. The apparatus set forth in claim 1 including:

means disposed adjacent said sidewall for scraping dried solids from said sidewall during rotation of said drum.

7. Apparatus for dehydrating a slurry of substantially water based drilling fluid and solids comprising drill cuttings, said apparatus comprising:

an elongated generally cylindrical drum defining a combustion chamber;

means for rotating said drum generally about its longitudinal central axis;

an outer housing disposed around said drum and defining with said drum, an evaporation chamber;

means for burning a fuel in said combustion chamber to generate relatively large quantities of gaseous combustion products and heated gases for heating said drum;

means for discharging said slurry against a cylindrical sidewall of said drum for exposing said slurry to the heat generated by said combustion products for dehydrating the solids of said slurry;

first exhaust flue means for conducting a flow of vapor generated from dehydrating said slurry out of said evaporation chamber;

second exhaust flue means for conducting said combustion products out of said combustion chamber; and an exhaust stack for mixing said combustion products and said vapors prior to discharge from said apparatus.

8. Apparatus for dehydrating a slurry of substantially water based drilling fluid and solids comprising drill cuttings, said apparatus comprising:

an elongated generally cylindrical drum and means for rotating said drum generally about its longitudinal central axis;

an outer housing disposed around said drum;

means for burning a fuel in a chamber defined at least in part by said drum to generate relatively large quantities of gaseous combustion products and heated gases for heating said drum;

means for discharging said slurry against a cylindrical sidewall of said drum for exposing said slurry to the heat generated by said combustion products for dehydrating the solids of said slurry;

first exhaust flue means for conducting a flow of vapor generated from dehydrating said slurry away from said apparatus; and second exhaust flue means for carrying said combustion products out of said apparatus and disposed in relation to said first flue means so as to mix the flow of vapor with the flow of combustion products.

9. The apparatus set forth in claim 8 wherein:

said first flue means includes a stack portion for mixing said vapor and said vapor and said combustion products prior to discharge from said apparatus.

10. The apparatus set forth in claim 8 wherein:

said second flue means includes an outlet portion disposed in relation to said first flue means so as to induce the flow of vapor and ambient air to flow through said apparatus and exit through said first flue means.

11. Apparatus for dehydrating a slurry such as well drilling fluid containing a quantity of solids comprising drill cuttings, said apparatus comprising:

a generally cylindrical outer housing;

an elongated cylindrical drum disposed in said housing and dividing a space in said housing into first and second chambers defined at least in part by said drum, said drum being substantially open at opposite ends thereof for conducting heated air through said drum;

means for burning a fuel in one of said chambers to generate gaseous combustion products to heat said drum and said chambers;

means for supporting said drum for rotation in said housing;

means for discharging said slurry against a sidewall of said drum for dehydrating said slurry;

first exhaust flue means in communication with one of said chambers for conducting a flow of vapor generated from dehydrating said slurry away from said apparatus;

said housing being open at opposite ends thereof for conducting a relatively large volume of ambient air and vapor from said slurry through one of said chambers to said first flue means; and second exhaust flue means in communication with the other of said chambers for carrying said combustion products out of said apparatus.

12. The apparatus set forth in claim 10 wherein:

said apparatus includes an exhaust stack for conducting combustion products and vapor from said apparatus; and said second flue means is disposed in relation to said first flue means so as to provide for mixing gases discharged from said apparatus to reduce the water vapor concentration of said gases.

* * * * *